US006953530B2

(12) United States Patent
Kanri

(10) Patent No.: US 6,953,530 B2
(45) Date of Patent: Oct. 11, 2005

(54) FORMING METHOD OF INK JET PRINT HEAD SUBSTRATE AND INK JET PRINT HEAD SUBSTRATE, AND MANUFACTURING METHOD OF INK JET PRINT HEAD AND INK JET PRINT HEAD

(75) Inventor: Ryoji Kanri, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 185 days.

(21) Appl. No.: 10/081,184

(22) Filed: Feb. 25, 2002

(65) Prior Publication Data

US 2002/0118255 A1 Aug. 29, 2002

(30) Foreign Application Priority Data

Feb. 28, 2001 (JP) ..... 2001/055081
Jan. 29, 2002 (JP) ..... 2002/019348

(51) Int. Cl.[7] ..... B41J 2/16

(52) U.S. Cl. ..... 216/27; 216/33; 216/34; 216/36; 216/49; 216/54

(58) Field of Search ..... 216/27, 33, 34, 216/35, 36, 49; 347/54

(56) References Cited

U.S. PATENT DOCUMENTS 4,601,777 A 7/1986 Hawkins et al. ..... 156/626
5,458,254 A 10/1995 Miyagawa ..... 216/27
5,478,606 A 12/1995 Ohkuma et al. ..... 427/555
5,871,657 A * 2/1999 Nelson ..... 216/27
6,379,571 B1 * 4/2002 Kobayashi et al. ..... 216/27
2002/0006581 A1 * 1/2002 Motoi et al. ..... 430/271.1

FOREIGN PATENT DOCUMENTS

EP 0 481 788 A1 4/1992
EP 0 535 772 A2 4/1993
EP 0962320 A1 12/1999
JP 54-51837 4/1979
JP 5-330066 12/1993
JP 6-286149 10/1994
JP 11-348290 12/1999

* cited by examiner

*Primary Examiner*—Anita Alanko
(74) *Attorney, Agent, or Firm*—Fitzpatrick, Cella, Harper & Scinto

(57) ABSTRACT

The invention provides a forming method of an ink jet print head substrate and an ink jet print head substrate, and a manufacturing method of an ink jet print head and an ink jet print head, in which adhesion between a substrate for forming an ink discharging pressure generating element and an ink flow path forming member is increased to increase reliability even if an ink flow path forming member is formed covering a long distance. In a forming method of an ink jet print head substrate or the like, in which an ink flow path forming member is attached onto a substrate on which an ink discharging pressure generating element is formed, minute pit is formed on an attachment region of the substrate for attaching the liquid flow path forming member.

5 Claims, 5 Drawing Sheets

FORMING METHOD OF INK JET PRINT HEAD SUBSTRATE AND INK JET PRINT HEAD SUBSTRATE, AND MANUFACTURING METHOD OF INK JET PRINT HEAD AND INK JET PRINT HEAD

BACKGROUND OF THE INVENTION

1. Field of the Invention

The present invention relates to a forming method of an ink jet print head substrate and an ink jet print head substrate, and a manufacturing method of an ink jet print head and an ink jet print head.

2. Related Background Art

Conventionally an ink jet recording method is known, as indicated by Japanese Patent Application Laid-Open No. 54-51837, in which recording is performed by applying thermal energy to liquid to generate a force to discharge a liquid droplet. Specifically, in this ink jet recording method, a liquid under thermal energy application is overheated to generate bubbles, the force due to the bubble generation produces a liquid droplet through an orifice at a tip of a recording head section, and then this droplet adheres to a recording medium, thereby achieving information recording.

An ink jet print head used in this recording method generally comprises: an orifice prepared in order to discharge liquid; a liquid discharging section with a liquid flow path comprising a heating section in communication with the orifice, thermal energy for discharging a liquid droplet being applied to the liquid in the heating section; a heat-generating resistive layer as a thermal converter that is means to generate thermal energy; an upper protective layer for protecting the heat-generating resistive layer from ink; and a lower layer for reserving heat.

Methods of forming nozzles and discharge ports with high density and high precision for such an ink jet print head are proposed, for example, in Japanese Patent Application Laid-Open No. 5-330066, and Japanese Patent Application Laid-Open No. 6-286149 is proposed.

In recent years, as ink jet printers with higher level performance are present, a print head that enables higher speed printing is required. For this reason, it is proposed to increase the width for one printing in order to increase printing speed.

However, in the above-mentioned conventional example indicated in Japanese Patent Application Laid-Open No. 6-286149, in order to attain the above described object, ink discharge ports need to be arranged over a longer distance. And for this reason, it is important that adhesion between a substrate with an ink discharging pressure generating element formed thereon, and an ink flow path forming member is higher.

Therefore, for example, in Japanese Patent Application Laid-Open No. 11-348290, a method is proposed to use an adhering (closely contacting) layer comprising a polyether amide resin so as to increase the adhesion between a substrate with an ink discharging pressure generating element formed thereon and an ink flow path forming member. However, there is still a possibility of problems such as floating-up and peeling of the ink flow path forming member because of the increased nozzle row length, even if an adhering layer comprising such a polyether amide resin is used.

SUMMARY OF THE INVENTION

An objective of the present invention is to solve the above described subjects and to provide a forming method of an ink jet print head substrate and an ink jet print head substrate, and a manufacturing method of an ink jet print head and an ink jet print head in which adhesion between a substrate for forming an ink discharging pressure generating element and an ink flow path forming member is increased to provide a high reliability even if the ink flow path forming member is formed over a long distance.

Moreover, an objective of the present invention is to provide an ink jet print head substrate and a forming method of the same, and an ink jet print head and a manufacturing method of the same that are defined by the following (1) to (7), in order to solve the above described problems.

(1) A forming method of an ink jet print head substrate in which an ink flow path forming member is attached onto a substrate for forming an ink discharging pressure generating element, wherein a minute pit is formed on an attachment region of the substrate for attaching the liquid flow path forming member.

(2) The forming method of an ink jet print head substrate according to (1), wherein the minute pit is formed by anisotropic etching.

(3) The forming method of an ink jet print head substrate according to (2), wherein at least a part of an etching mask for the anisotropic etching is made of polyether amide resin.

(4) The forming method of an ink jet print head substrate according to (3), wherein the polyether amide resin layer also serves as an adhering layer between the substrate and the liquid flow path forming member.

(5) An ink jet print head substrate formed by a forming method of an ink jet print head substrate according to the (1) to (4).

(6) A manufacturing method of an ink jet print head using an ink jet print head substrate formed by a forming method of an ink jet print head substrate according to any one of (1) to (4), wherein a discharge port for discharging ink, a liquid path communicating with the discharge port and also including the ink discharging pressure generating element, a liquid flow path forming member attached with the substrate to form the liquid path are formed on the substrate.

(7) An ink jet print head manufactured by a manufacturing method of an ink jet print head according to (6).

According to the above described constitution, it is possible to achieve a forming method of an ink jet print head substrate and an ink jet print head substrate, and a manufacturing method of an ink jet print head substrate and an ink jet print head and an ink jet print head that provide good adhesion and high reliability if a long ink flow path is provided.

Moreover, in an embodiment of the present invention, according to the above described constitution, crystal anisotropy etching of silicon may be used, for example, to form minute pit on the attachment region on the substrate for attaching with the liquid flow path forming member forming the liquid path of the substrate. In this anisotropic etching, since a feature surrounded by a (111) crystal face having an extremely low etching rate for alkaline etching liquid is formed, after minute pit is formed, etching is practically stopped. For this reason, a strict controlling of etching time is not required and a sufficient time of etching for forming minute pit is only needed. And therefore, a deep and big pit and very minute pit may also be formed simultaneously.

And anisotropic etching allows processing of many wafers simultaneously, and also has an advantage that the process load can be reduced.

Since a polyether amide resin is highly resistant to strong alkaline aqueous solution used as etching liquid in anisotropic etching, it may be used as an anisotropic etching mask. For this reason, the polyether amide resin layer used as an anisotropic etching mask can also serve as an adhering layer, and therefore the process load can be reduced.

And thus an ink jet print head having a good adhesion and high reliability may be provided by applying the above described constitution even when a long ink flow path is disposed.

DESCRIPTION OF THE PREFERRED EMBODIMENTS

Detailed description of examples of the present invention will be made hereinafter.

In examples of the present invention, a minute pit is formed on a substrate and adhesion of an ink flow path forming member to alkaline ink was estimated by an accelerated test.

First, a five-inch silicon wafer was prepared as a substrate, and a silicon nitride film of 3000 Å (angstrom) was formed on it with LP-CVD.

Subsequently, patterning was performed to form patterns of minute pit on the silicon nitride film using a positive resist OFPR-800 manufactured by TOKYO OHKA KOGYO CO., LTD. In addition, a "pit" herein generally means a hole, a dimple or the like as shown in the following examples.

Subsequently, the substrate was dipped in tetramethyl ammonium hydroxide aqueous solution (22wt %, 83.0° C.) for 10 minutes to be subject to anisotropic etching so that etched pits with a depth of about 3 μm are formed.

In the next step, ink flow path patterns of a positive resist ODUR manufactured by TOKYO OHKA KOGYO CO., LTD. were formed on the substrate, then an epoxy resin layer was further formed on the substrate, and patterned to form discharge ports.

Then the ink flow path pattern of ODUR was removed, and further a baking under a condition of 200° C./60 minutes was performed so that the epoxy resin as a nozzle composition member is completely cured.

A sample without the etched pit for improving adherence was simultaneously manufactured as a comparative example. Subsequently, after these samples were immersed in an ink containing ethylene glycol/urea/isopropyl alcohol/black dyestuff/water=5/3/2/3/87 parts respectively, the samples was subject to pressure cooker test (PCT) (120° C., two atmospheric pressure, 50 Hours), and the change of flow path pattern was inspected.

Here, urea is added to the above described ink as a moisturing component (a component for decreasing evaporation of ink and for preventing a nozzle clogging), and when urea is hydrolyzed, it shows alkalinity.

In the samples provided with the minute pit according to a constitution of the example, no change in pattern shape was seen after the PCT examination. On the contrary, some interference patterns and stripping were observed in a part of the pattern on the samples without minute pit. It is conceivable that these defects were generated because adhesion between a silicon nitride layer and a flow path formation material was not enough.

EXAMPLE 1

A manufacturing method of an ink jet print head in the example will be illustrated using FIGS. 2A to 2G.

In Example 1 of the present invention, an ink jet print head is manufactured by a method shown in FIGS. 2A to 2G, and the result of adhesion evaluation is shown below.

Figure 2A:
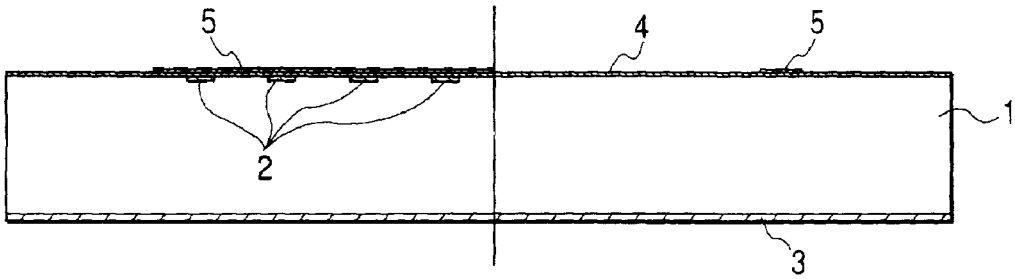
FIGS. 2A, 2B, 2C, 2D, 2E, 2F, and 2G illustrate a manufacturing method of an ink jet print head in Example 1 of the present invention.

First, an electric thermal conversion element 2 was disposed as an ink discharging pressure generating element on a surface of a silicon substrate 1 (crystal orientation: <100>, thickness: 625 μm), and a silicon nitride layer 4 and a Ta layer 5 were further formed as a protective layer as shown in FIG. 2A. A transistor circuit and wirings for driving each element were connected to the electric thermal conversion element 2 (not shown).

Figure 2B:
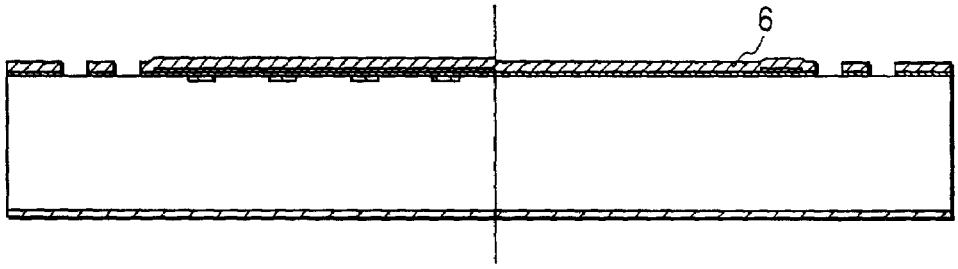

Subsequently, a layer 6 with a thickness of 2.0 μm made of polyether amide was formed by the following methods on the substrate 1 as an etching mask for forming etched pit (hereinafter referred to as a "pit" and a "minute pit") by anisotropic etching. In this example, as a polyether amide layer, HIMAL 1200 manufactured by Hitachi Chemical Co., Ltd. was used, and was applied to the substrate 1 using a spinner, and baking was performed under conditions for 100° C./30 minutes+250° C./60 minutes. Subsequently, a pattern is formed using photo resist on the above described HIMAL (polyether amide layer). A patterning of the HIMAL layer was performed by an oxygen plasma ashing using the resist pattern as a mask, and also a patterning of the silicon nitride layer was performed by a dry etching using $O_2$+$CF_4$. Then, the resist pattern used as a mask was stripped off and an etching mask shown in the figure was formed (FIG. 2B). Here, a positive resist FH-SP manufactured by FUJIFILM OLIN Co., Ltd. was used as a resist containing silicon having a good oxygen plasma-proof nature. Since a resist mask can be made thinner using a resist having a good oxygen-proof plasma nature, a much finer pit pattern can be formed.

Figure 2C:
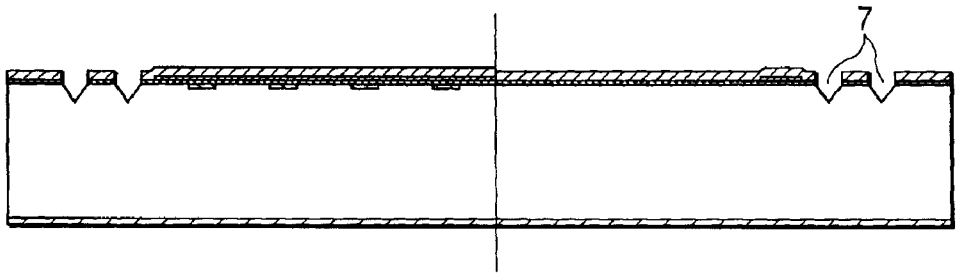

Subsequently, the substrate 1 was immersed in tetramethyl ammonium hydroxide aqueous solution (22wt %, 83.0° C.) for 10 minutes to be subject to anisotropic etching so as to form minute pit 7 with a depth of about 3 μm directly on the silicon substrate 1 (FIG. 2C). In this case, the use of the HIMAL layer 6 is preferable, since the layer serves as a protective film that protects an electric thermal conversion element, driving transistors and wirings on the substrate from corrosion by the TMAH solution, as well as serves as an etching mask for etched pit formation. Moreover, a protective film of a silicon oxide layer 3 has been formed on the back side of the substrate beforehand.

Figure 2D:
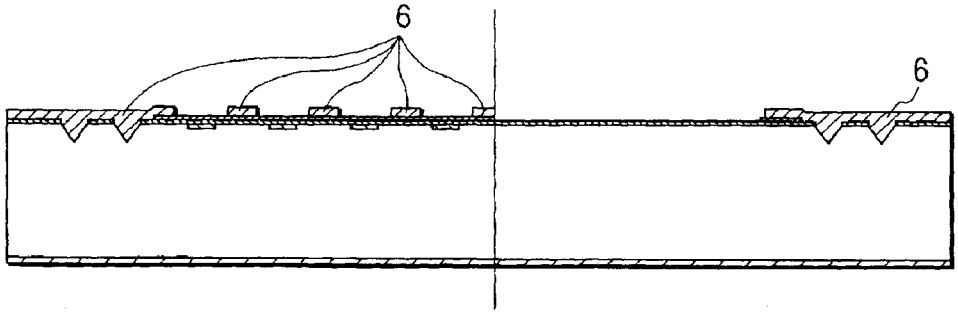
Figure 2E:
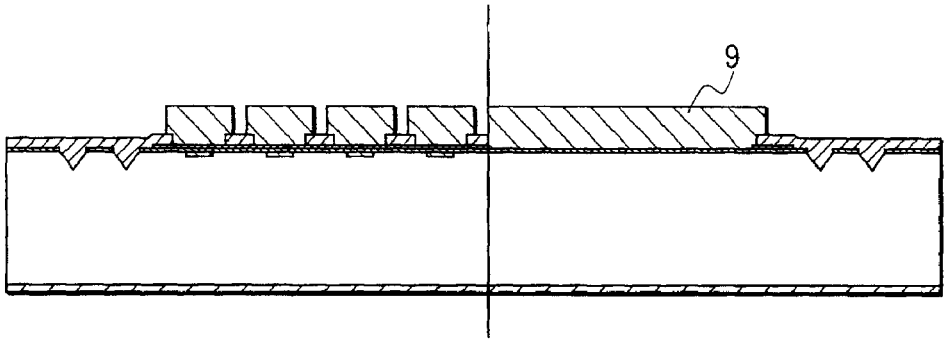

In the next step, the HIMAL layer used as an etching mask was stripped off by oxygen plasma ashing (not shown), and subsequently, after HIAML was applied again and baking was performed, HIMAL layer was patterned using OFPR800 by oxygen plasma ashing, and an adhering layer 8 (not shown) of polyether amide 6 was formed (FIG. 2D). Here, polyether amide 6 and the adhering layer 8 represent the same object.

Figure 2F:
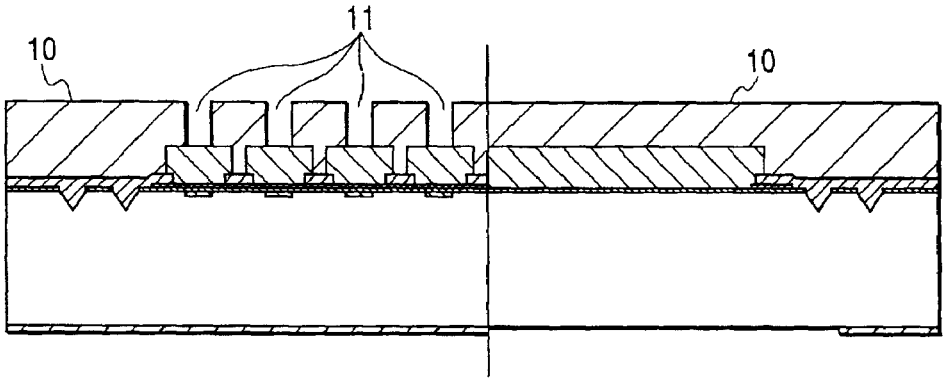

Subsequently, an ink flow path pattern 9 of a positive resist ODUR manufactured by TOKYO OHKA KOGYO CO., LTD. was formed on the substrate 1 (FIG. 2E), and further, after an epoxy resin layer 10 was formed on the substrate, discharge ports 11 were formed by patterning (FIG. 2F).

Figure 2G:
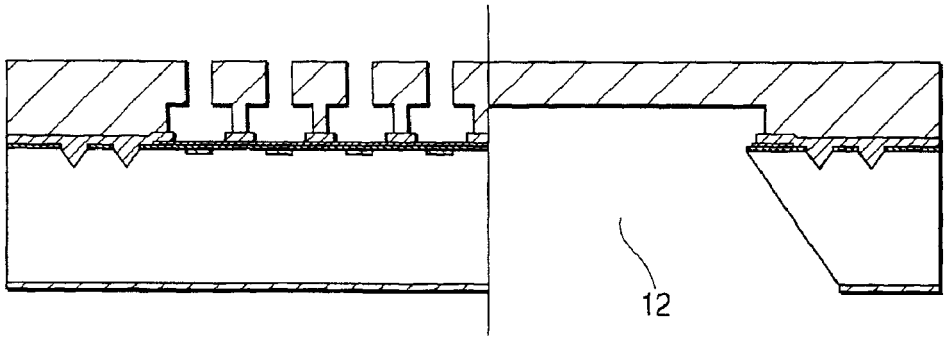

Next, a silicon oxide formed beforehand in the back side was patterned (FIG. 2F), and was immersed in tetramethyl ammonium hydroxide aqueous solution (22wt %, 83° C.) for 16 hours. Thus anisotropic etching was performed to form an ink supply port 12 using the patterned oxide as a mask (FIG. 2G). In this case, a cyclized rubber derived resist was applied as a protective film onto a wafer surface on which the ink discharge port 11 was formed so that a TMAH aqueous solution does not contact with the wafer surface. Subsequently, the silicon nitride layer on an ink supply port and the ink flow path pattern 9 of ODUR were removed, and furthermore in order to completely cure epoxy resin 10 as a nozzle component, the substrate was baked under a condition of 200° C./60 minutes to obtain an ink jet print head chip (FIG. 2G).

Furthermore, an ink jet print head chip without etched pit was also manufactured as a comparative example. These ink jet print heads were filled with an ink given in Example 1, and a preservation test was performed under a condition of 60° C./three months. In the ink jet print head having etched pit, no change was observed at all in the adhesion area between the nozzle component (including the adhering layer) and the substrate. On the contrary, in the comparative example (having no etched pit), there was observed a portion where some interference patterns were generated in the adhesion area between the nozzle composition member (including the adhering layer) and the substrate.

Moreover, in FIG. 2G of this example the lower portion of the polyether amide layer 6 (adhering layer 8) fill the minute pit and the upper surface is flat, but another minute pit may be formed also in the upper surface of the polyether amide layer 6 corresponding to positions of the minute pit depending on the process conditions. By this way, minute pit are also formed between the adhering layer 8 and the ink flow path forming member 10, and therefore, it is more preferable in the viewpoint of adhesion.

EXAMPLE 2

Figure 1A:
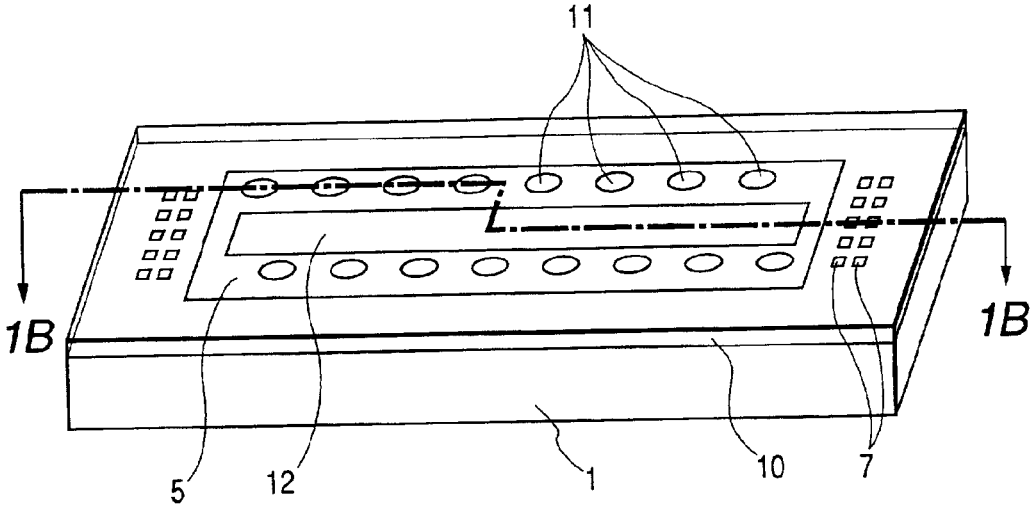
FIG. 1A is a perspective view of an ink jet print head in example of the present invention.
Figure 1B:
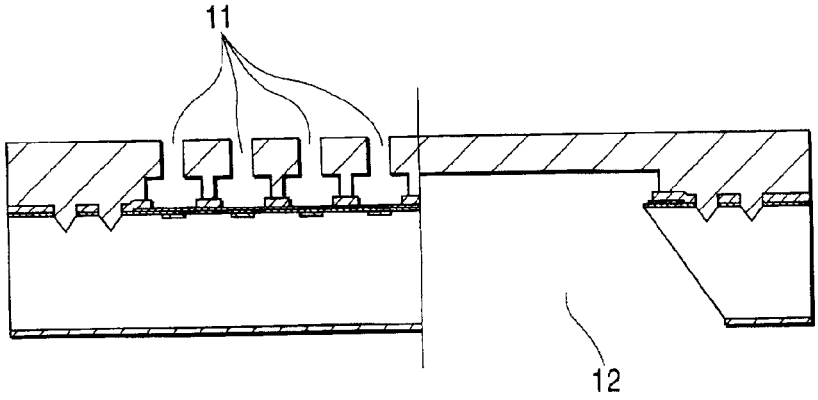
FIG. 1B is a sectional view taken along the line 1B—1B of FIG. 1A.

In Example 2 of the present invention, an ink jet print head as shown in FIGS. 1A and 1B were manufactured using a method shown in FIGS. 3A to 3G. FIG. 1A is a perspective view of an ink jet print head, and FIG. 1B is a sectional view taken along the line 1B—1B of FIG. 1A.

Figure 3A:
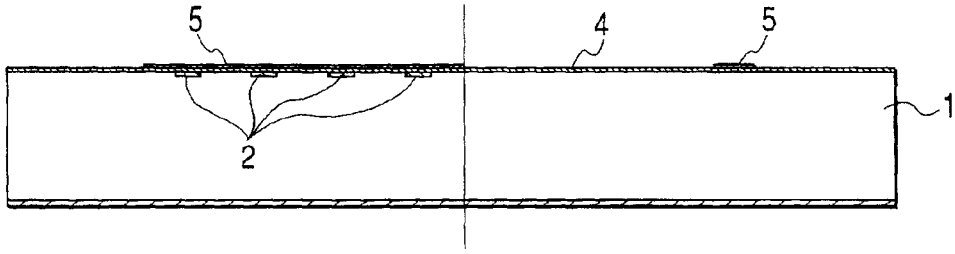
FIGS. 3A, 3B, 3C, 3D, 3E, 3F, and 3G illustrate a manufacturing method of an ink jet print head in Example 2 of the present invention.

First, an electric thermal conversion element 2 was disposed on a surface of a silicon substrate 1 (crystal orientation: <100>, thickness: 625 $\mu$m) as an ink discharging pressure generating element, and further a silicon nitride layer 4 and a Ta layer 5 were formed as protective layers (FIG. 3A). In addition, a transistor circuit and wirings for driving each element were connected to the electric thermal conversion element 2 (not shown).

Subsequently, a layer 6 with a thickness of 2.0 $\mu$m of polyether amide was formed on the substrate 1 as an etching mask for forming the minute pit 7 by anisotropic etching (FIG. 3B), by the following methods. As a polyether amide layer, HIMAL1200 manufactured by Hitachi Chemical Co., Ltd. was used, and was applied to the above described substrate 1 using a spinner, and baking was performed under conditions of 100° C./30 minutes+250° C./60 minutes.

Figure 3B:
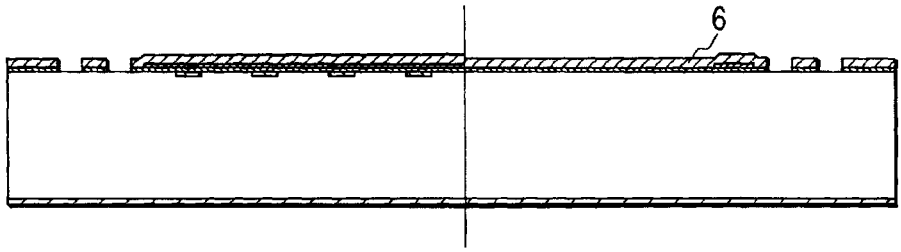

Subsequently, a pattern was formed using FH-SP manufactured by FUJIFILM OLIN Co., Ltd. on the HIMAL (polyether amide layer 6). A patterning of the HIMAL layer was performed by an oxygen plasma ashing using the FH-SP pattern as a mask, and also a patterning of the silicon nitride layer was performed by a dry etching using $CF_4$. Finally, the FH-SP pattern used as a mask was stripped off so as to form an etching mask shown in the figure (FIG. 3B).

Figure 3C:
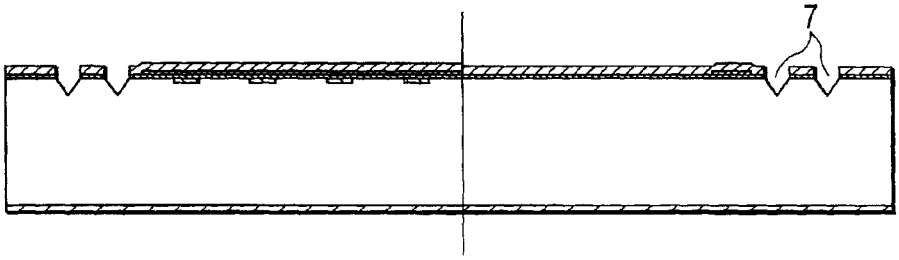

Subsequently, the substrate 1 was immersed in tetramethyl ammonium hydroxide aqueous solution (22wt %, 83.0° C.) for 10 minutes to be subject to anisotropic etching so that minute pit 7 with a depth of about 3 $\mu$m were formed (FIG. 3C). In this case, the HIMAL layer served as a protective film that protects an electric thermal conversion element, transistors for driving and wiring on the substrate from corrosion by the TMAH solution, as well as served as an etching mask for minute pit formation. Moreover, a protective film of a silicon oxide layer 3 has been formed on the back side of the substrate beforehand.

Figure 3D:
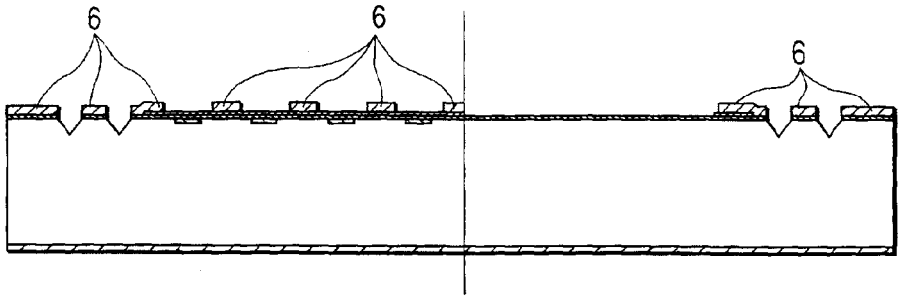
Figure 3E:
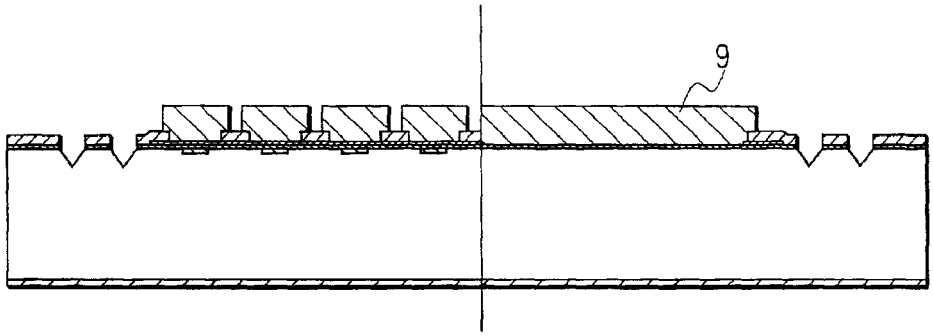

Subsequently HIMAL layer was patterned again using OFPR800 by oxygen plasma ashing, and an adhering layer 8 (shown as a polyether amide layer 6) was formed (FIG. 3D). In this example, HIMAL layer used as an etching mask for minute pit formation served also as the adhering layer 8. This is preferable, because it permits simplification and cost education of the manufacturing process.

Figure 3F:
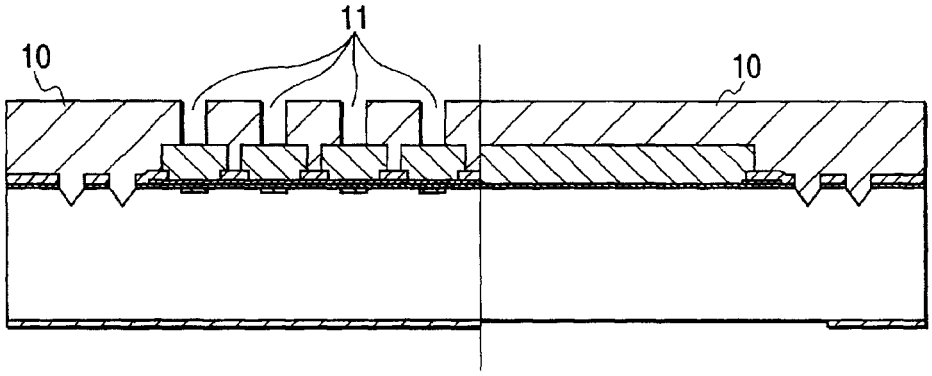

Subsequently, an ink flow path pattern 9 of a positive resist ODUR by TOKYO OHKA KOGYO CO., LTD. was formed on the substrate 1 (FIG. 3E), and further, after an epoxy resin layer 10 was formed on the substrate, discharge ports 11 were formed by patterning (FIG. 3F).

Figure 3G:
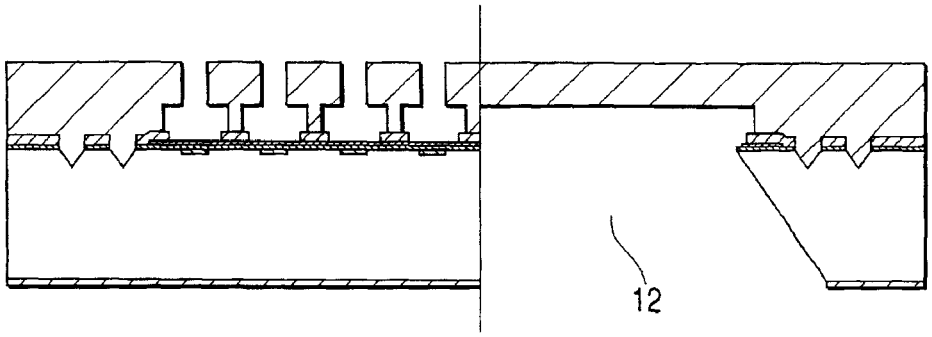

Next, a silicon oxide formed beforehand in the back side was patterned (FIG. 3F), and was immersed in tetramethyl ammonium hydroxide aqueous solution (22wt %, 83° C.) for 16 hours. Thus anisotropic etching was performed to form an ink supply port 12 using the patterned silicon oxide 1 as a mask (FIG. 3G). In this case, a cyclized rubber derived resist was applied as a protective film onto a wafer surface on which the ink discharge port 11 was formed so that a TMAH aqueous solution does not contact with the wafer surface. Subsequently, the silicon nitride layer on an ink supply port and the ink flow path pattern 9 of ODUR were removed, and furthermore in order to completely cure epoxy resin 10 of a nozzle composition member, the substrate was baked under a condition of 200° C./60 minutes to obtain an ink jet print head chip (FIG. 3G).

Furthermore, an ink jet print head chip having no etched pit was also manufactured as a comparative example. These ink jet print heads were filled with the above described ink, and a preservation test was performed under a condition of 60° C./three months. In the ink jet print head having etched pit, as in the case of Example 1 no change was observed at all in the adhesion area between the nozzle composition member (including the adhering layer) and the substrate. On the contrary, in the comparative example (having no etched pit), there was observed a portion where some interference patterns were generated in the adhesion area between the nozzle composition member (including the adhering layer) and the substrate.

As mentioned above, it should be understood that when formed for an actual ink jet print head the minute pit provide an excellent effect in adhesion with an ink flow path forming member.

Although the minute pit and the ink supply port were separately formed in the above Example 1 and Example 2, they may be formed at the same time beforehand, and subsequently an ink flow path and a discharge port may be formed. In this case, the manufacturing process may further be shortened.

While this example has been illustrated where an adhering layer 8 of a polyether amide layer 6 is used, an adhering layer 8 is not essential in the present invention. The reason is because adhesion between the ink flow path forming member 10 and the silicon substrate 1 can be much higher than conventional methods because of the minute pit formed according to the present invention.

As described above, by preparing the pit directly on a silicon substrate, adhesion between the ink flow path forming member 10 and the silicon substrate 1 is improved. Therefore, even if a nozzle length (head length) is increased, prevention of the stripping-off is ensured. Moreover, as shown in FIGS. 1A and 1B, the pit formed in close proximity to an end in the longitudinal direction of the head act effectively against the stress due to the increased head length which causes stripping-off. Furthermore, it is preferable that an array constitution comprising two or more rows as shown in FIGS. 1A and 1B are employed.

In the above described examples, while a constitution was described where a heat-generating element is used as an ink discharging pressure generating element, the present invention is not limited to the constitution and can be applied also to a head in which a piezoelectric element is used.

What is claimed is:

1. A method for manufacturing an ink jet print head in which an ink flow path is formed by contacting a substrate for forming an ink discharging energy generating element with an ink flow path forming member for forming the ink flow path, said method comprising the steps of:

providing a layer on the substrate, at least a portion of the layer being polyether amide resin;

forming a pit on the substrate by performing anisotropic etching of the layer as an etching mask; and providing the ink flow path forming member on the substrate so that the ink flow path forming member is in contact with the pit on the substrate.

2. An inkjet print head substrate formed by the method of an ink jet print head substrate according to claim 1.

3. A manufacturing method for making an ink jet print head using an ink jet print head substrate formed using the method according to claim 1, wherein a discharge port for discharging ink, a liquid path communicating with the discharge port and also including the ink discharging energy generating element, a liquid flow path forming member attached with the substrate to form the liquid path are formed on the substrate.

4. The manufacturing method according to claim 3, wherein the pit is formed in proximity to both ends of a longitudinal direction in the ink jet print head.

5. An ink jet print head manufactured using the manufacturing method of an ink jet print head according to claim 3.

* * * * *

UNITED STATES PATENT AND TRADEMARK OFFICE

CERTIFICATE OF CORRECTION

PATENT NO. : 6,953,530 B2
DATED : October 11, 2005
INVENTOR(S) : Ryoji Kanri

It is certified that error appears in the above-identified patent and that said Letters Patent is hereby corrected as shown below:

Title page,
Item [30], Foreign Application Priority Data, "2001/055081" should read -- 2001-055081 --; and 2002/019348" should read -- 2002-019348 --.
Item [57], ABSTRACT,
Line 12, "minute" should read -- a minute --.

Column 3,
Line 62, "moisturing" should read -- moistening --.

Column 5,
Line 30, "fill" should read -- fills --;
Line 34, "pit" should read -- pits --; and
Line 41, "were" should read -- was --.

Column 6,
Line 4, "were" should read -- was --;
Line 17, "education" should read -- reduction --; and
Line 50, "provide" should read -- provides --.

Column 7,
Line 4, "act" should read -- acts --; and
Line 8, "are" should read -- is --.

Column 8,
Line 4, "substrate." should read -- substrate, wherein the polyether amide resin layer also serves as an adhering layer between the substrate and the ink flow path forming member. --; and

UNITED STATES PATENT AND TRADEMARK OFFICE

CERTIFICATE OF CORRECTION

PATENT NO. : 6,953,530 B2
DATED : October 11, 2005
INVENTOR(S) : Ryoji Kanri

It is certified that error appears in the above-identified patent and that said Letters Patent is hereby corrected as shown below:

Column 8 (cont'd),
Line 5, "inkjet" should read -- ink jet --.

Signed and Sealed this

Twenty-first Day of March, 2006

JON W. DUDAS
*Director of the United States Patent and Trademark Office*